United States Patent [19]

Sonne

[11] Patent Number: 4,533,137

[45] Date of Patent: Aug. 6, 1985

[54] PULMONARY TRAINING METHOD

[75] Inventor: Leonard J. Sonne, Boston, Mass.

[73] Assignee: HealthScan Inc., Upper Montclair, N.J.

[21] Appl. No.: 587,863

[22] Filed: Mar. 13, 1984

Related U.S. Application Data

[63] Continuation of Ser. No. 340,734, Jan. 19, 1982, abandoned, which is a continuation of Ser. No. 128,283, Mar. 7, 1980, abandoned.

[51] Int. Cl.[3] ..... A63B 23/00

[52] U.S. Cl. ..... 272/99; 128/725; 128/207.16

[58] Field of Search ..... 128/725, 726, 727, 914, 128/207.16, 720; 272/99 R

[56] References Cited

U.S. PATENT DOCUMENTS

| | | | |
|---|---|---|---|
| 3,710,780 | 1/1973 | Milch | 272/99 |
| 4,025,070 | 5/1977 | McGill et al. | 128/725 |
| 4,138,105 | 2/1979 | Hunger et al. | 128/725 |
| 4,143,872 | 3/1979 | Havstad et al. | 272/99 |
| 4,221,381 | 9/1980 | Ericson | 128/727 |

OTHER PUBLICATIONS

Anderson et al., "Resistive Breathing Training in Severe Chronic Obstructive Pulmonary Disease", Resp. J. Resp. Dis., (1979), 60, 151–156.

Leith et al., "Ventilatory Muscle Strength and Endurance Training", Journal of Applied Physiology, vol. 41, No. 4, Oct. 1976.

Sonne et al., "Increased Exercise Performance in Patients with Severe Chronic Obstructive Pulmonary Disease Following Inspiratory Resistive Training", American Lung Assoc.-American Thoracic Society Annual Meeting, May 10–13, 1981, Detroit, Mich., pp. 1–11.

Pardy et al., "Inspiratory Muscle Training Compared with Physiotherapy in Patients with Chronic Airflow Limitations", Am. Rev. Respir. Dis., 1981; 123: 421–425.

Pardy et al., "The Effects on Inspiratory Muscle Training on Exercise Performance in Chronic Airflow Limitations", Am. Rev. Respir. Dis., 1981; 123: 426–433.

*Primary Examiner*—Henry J. Recla

*Attorney, Agent, or Firm*—Brooks Haidt Haffner & Delahunty

[57] ABSTRACT

A pulmonary training method for persons having COPD involving daily exercise by inhaling through a restricted opening with inspirative resistance less than that producing stress.

1 Claim, 8 Drawing Figures

PULMONARY TRAINING METHOD

This application is a continuation of copending application Ser. No. 340,734, filed Jan. 19, 1983 and now abandoned, which is in turn a continuation of copending application Ser. No. 128,283, filed Mar. 7, 1980 and now abandoned.

This invention relates to pulmonary exercise and in particular provides a method of pulmonary training or improving the endurance of the inspiratory muscles.

The present invention has particularly applicability to improving the inspiratory muscular endurance of persons having chronic obstructive pulmonary disease (COPD) and has an object the conversion of Type B chronic bronchitic emphysema with congestive heart failure, respiratory failure and edema, to Type A emphysema without $CO_2$ retention or heart failure. The training method of this invention can also be of use in weaning patients from mechanical ventilation and has value even for healthy persons, such as athletes, divers, and singers, to improve their respiratory musculature such that it is more efficient.

The method of the invention is also effective in improving cough in all patients with COPD, and can be used as a preoperative method to improve the condition of patients undergoing thoracic or upper abdominal surgery, and is of general value in rehabilitating patients with pulmonary problems from chest wall or muscle disease.

The training method of the invention can enhance the overall ability of patients to perform exercise in cases in which the patients have increased energy requirement for respiration, i.e., have obstructive or restrictive disease. The method can be used as a preliminary training method before more routine total body exercise is attempted on elderly, debilitated, poorly trained subjects.

These and other objects of the invention are essentially obtained by requiring the patient or other person undergoing training in accordance with the invention to inhale repetitively through a device providing a restricted opening providing resistance to inspiration for regular periods of time on a regular basis, such as one-half hour to an hour daily. The inspirational resistance is obtained by inhaling through the mouth utilizing a device having an inlet opening less than the opening of the glottis, i.e. less than about one-half inch in diameter. The restricted opening utilized should not be so small as to induce fatigue or incoordination. The inspirational resistance is kept constant throughout each daily training session. Generally the maximum resistive loading is determined by using less than that which will produce stress e.g. tiring, shortness of breath, increased pulse rate and the like. Periodically, for example, weekly, the amount of inspiratory restriction is reassessed and increased for subsequent regular training sessions until reaching a restriction just less than that required to produce stress.

For a more complete understanding of the more practical application of this invention reference is made to the appended drawings in which.

Figure 1:
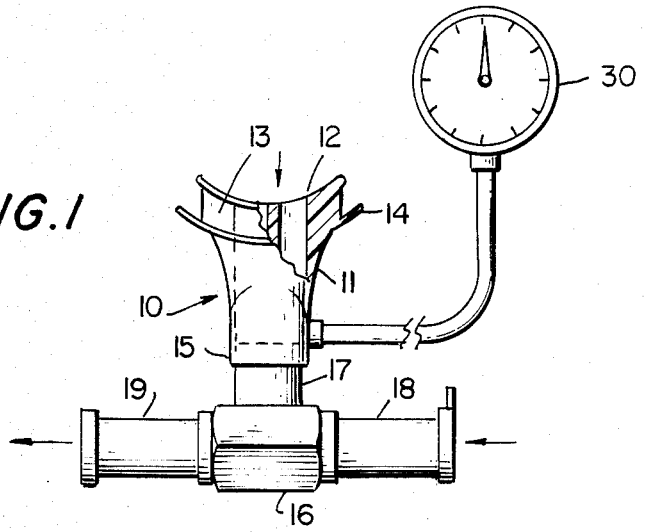
FIG. 1 is a plan view of a device utilized in carrying out the training method of this invention.
Figure 2:
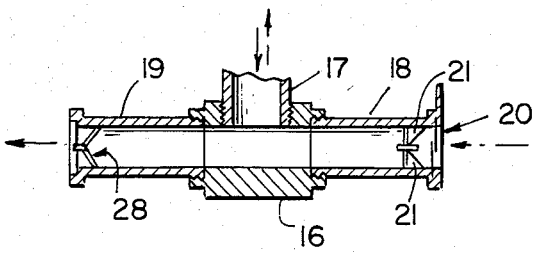
FIG. 2 is a longitudinal section through the device shown in FIG. 1.

Referring more particularly to FIG. 1, the reference numeral 10 denotes a breathing device suitable for carrying out the training method of this invention. Breathing device 10 in particular includes a mouth piece 11 of generally tubular construction having an enlarged end 12 including a tooth gripping portion 13 at end 12 intended for insertion into the mouth with a lip 14 intended to be received between the teeth and the lips of the mouth to seal the mouth opening. The other end 15 of the mouthpiece 11 tightly receives a tubular leg 17 of a T-shaped valve device, Tubular leg 17 is in open communication through body 16 of the valve device with both an intake tube 18 and an exhaust tube 19. (See also FIG. 2.)

Figure 5:
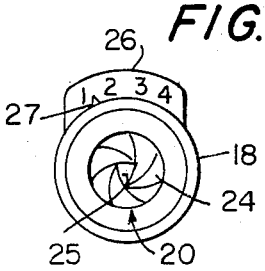
FIG. 5 is an end view of the portion shown in FIG. 3.
Figure 3:
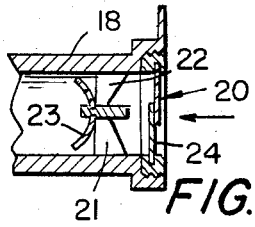
FIG. 3 is a fragmentary enlarged view of a portion of FIG. 2.

Referring also to FIG. 3, it will be seen that intake tube 18, which is an open communication through valve body 16 with leg 17, has at its outer end a diameter restricting device 20 and interiorally of that a one-way valve 21 in the form of a support spider 22 and flexible disk 23 held in position over the inner side of spider 22. As can be seen also with reference to FIG. 5, restrictive device 20 is a conventional iris diaphragm including a series of blades 24 slightly positioned over one another such that an opening 25 is formed at their center the diameter of which can be adjusted mechanically exteriorally of device 20. Suitably a scale 26 cooperating with a pointer 27 is utilized to indicate the diameter of opening 25 to which device 20 is adjusted.

Figure 4:
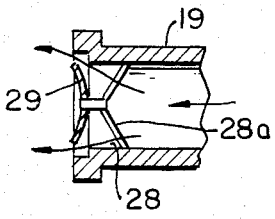
FIG. 4 is a fragmentary enlarged view of another portion of FIG. 2.

Exhaust tube 19, which is also interiorally in communication with leg 17 through valve body 16, as can be seen also with reference to FIG. 4, carries a one-way valve 28 in the form of a spider **28*a* supporting a flexible disk 29 which rests in the outer opening of tube 19**.

It will be immediately evident that when a trainee positions mouthpiece 11 in his mouth and inhales, valve 28 is closed by disk 29 resting securely over the end of tube 19 while valve 2 opens by disk 23 flexing away from spider 22, permitting inspiration through inlet tube 18, as restricted by the size of opening 25. A manometer 30 can be connected to mouthpiece 11 as shown in FIG. 1, if this is desired. Similarly upon exhaling through mouthpiece 11 valve 21 closes and valve 28 opens permitting the exhaled air to be vented without restriction through tube 19.

In carrying out the training method of this invention it is first necessary to train the patient to breathe through the mouthpiece. For this purpose training device 10 is employed with valve opening restriction device 20 wide open, such that the interior openings of leg 17 and tubes 18 and 19, which desirably are as large as the opening of the glottis, or larger are the only substantial restrictions to air flow through device 10. The patient then works at learning to breathe through his mouth only, both inhaling and exhaling through device 10. When the patient has mastered the technique of breathing through device 10 without any restriction imposed by device 20, which basically includes learning how to swallow with a mouthpiece 11 in the mouth and how to hold the mouthpiece with one's hand if the masticating muscles tire, the patient is then ready for actual training sessions utilizing restriction.

Training sessions should be substantially daily and approximately 30 minutes to one hour, or as tolerated, depending upon the rest, muscle strength and endurance the patient starts with. Typically the initial training is with opening 25 set to ⅓" diameter and is for 15 minutes the first day, working to one-half hour the following day and up to one hour over the course of a week. Routine pulmonary functions testing should be conducted every week or two, and at least each time prior to reducing the diameter of opening 25.

Opening 25 should be reduced in diameter approximately every one or two weeks, and following each reduction in diameter the training program should be cut back to 15 minutes and then slowly increased again. The reduction in size of diameter of opening 25, each time the diameter is reduced, should not be great. A 10% reduction in the diameter once every two weeks is preferred.

This procedure is repeated until the patient has been worked down to a point of stress. When each individual patient's point of stress is found, the diameter of opening restriction provided by device 10 should be backed off to that previously used when no stress is reached and from then on training should be continued substantially daily for periods of one-half hour to one hour, or as tolerated, at that last opening without further reduction.

As inspiratory resistance in device 10 is changed, the patient's inspiratory force should be measured before and after the training session. A significant decrease in inspiratory force at the conclusion of the session is evidence that the patient is overtrained and the newly selected resistance is too high. In the case training should be resumed using the resistance previously tolerated. Manometer 30 is useful for this measurement.

In cases of extremely debilitated patients, such as those who have suffered respiratory failure, it is desirable to measure inspiratory force throughout the training session. Any fatigue will thus be noticed immediately and prompt corrective action can be taken.

Figure 6:
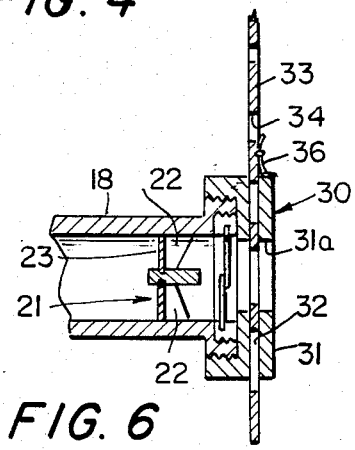
FIG. 6 is a view similar to FIG. 4 showing a modification in the inspirational loading device.
Figure 7:
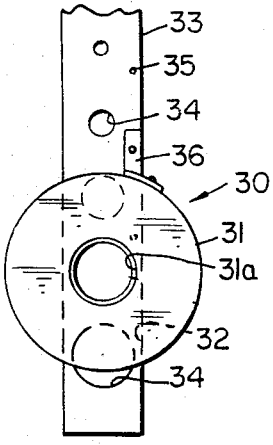
FIG. 7 is an end view of the portion of the device shown in FIG. 6.

FIGS. 6 and 7 show a modification of the end of intake tube 16 to accommodate a diameter changing device 30 in place of device 20. Device 30 includes a cap 31 having a central opening 31*a* aligned with the interior of tube 18 which is secured over the end of tube 18 and which has a transverse slide opening 32 receiving a slide 33 capable of movement through a series of positions relative to opening 31*a*. Thus slide 33 along its length is provided with a series of apertures 34 of varying diameter which can be aligned with opening 31*a*. A series of notches 35 are spaced along one edge of slide 33 and cooperate with a detent 36 attached to cap 31 to register with it such that, in each position of a notch 25 registering with detent 36, a particular aperture 34 is aligned with opening 31*a*.

It will be apparent that device 30 can be used in place of device 20 to control the aperture size through which restricted air passage is permitted into intake tube 18 and thus to control the resistance to inspiration provided by the device.

Figure 8:
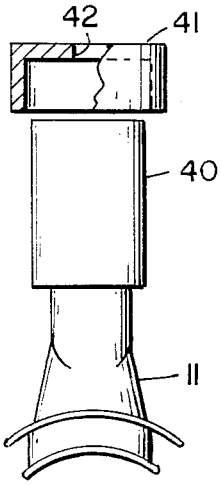
FIG. 8 is a view similar to FIG. 1 of a different device utilized in carrying out the training method of the invention.

FIG. 8 shows a simpler device of less expensive construction which can be utilized suitably to carry out the training method of this invention. In FIG. 8 a mouthpiece 11 identical with mouthpiece 11 shown in the preceding figures is utilized. This is attached to a one-way valve 40 which restricts exhaling but permits free inhalation and which is provided with a cap 41 having an opening 42. A series of caps 41 are utilized with different sized openings 42, varying typically from ½" down to 3/32" in diameter. The procedure described above with respect to device 10 is repeated except that exhalation must be through the nose. Diameter of restriction on inhalation is reduced by changing caps 41 to progressively smaller openings 42.

Device 40 is also useful in measuring inspiratory force, using a cap 41 without any aperture and by connecting a manometer to mouthpiece 11, as shown in FIG. 1.

I claim:

1. A training method for a person having COPD for improving pulmonary endurance which comprises having such person engage in a daily pulmonary exercise session by inhaling through an adjustable restricted opening to provide resistance to inspiration and by exhaling without restriction, assessing said resistance to inspiration required to cause the patient to reach the point of stress by observing, but not limited to, symptoms as tiring, shortness of breath and increased pulse rate, adjusting the restricted opening such that the inspirational resistance throughout each daily session is less than that necessary to produce said stress, reassessing the resistance required to cause the patient to reach the point of stress by observing, but not limited to symptoms as tiring, shortness of breath, and increased pulse rate on a periodic basis, and increasing the inspirational resistance by decreasing the size of said opening for subsequent daily sessions, as tolerance to inspirational resistance increases.

* * * * *